US005231798A

United States Patent [19]

Judge et al.

[11] Patent Number: 5,231,798

[45] Date of Patent: Aug. 3, 1993

[54] CENTERLESS MICROFINISHING MACHINE

[75] Inventors: Norman R. Judge, Dewitt; Arthur G. Reiser, Lansing, both of Mich.

[73] Assignee: Industrial Metal Products Corporation, Lansing, Mich.

[21] Appl. No.: 987,257

[22] Filed: Dec. 7, 1992

Related U.S. Application Data

[63] Continuation of Ser. No. 782,986, Oct. 28, 1991, abandoned.

[51] Int. Cl.[5] ..... B24B 5/18

[52] U.S. Cl. ..... 51/103 WH; 51/62; 51/103 R; 51/145 R; 51/215 UE; 51/238 GG

[58] Field of Search ..... 51/59 R, 62, 137, 142, 51/145 R, 147, 103 R, 103 C, 103 WH, 103 TF, 215 AR, 215 HM, 215 UE, 238 S, 238 GG

[56] References Cited

U.S. PATENT DOCUMENTS

| | | | |
|---|---|---|---|
| 1,850,372 | 3/1932 | Binns | 51/215 HM |
| 2,027,626 | 1/1936 | Blood et al. . | |
| 2,050,482 | 8/1926 | Blood et al. . | |
| 2,743,555 | 5/1956 | Irvine | 51/103 TF |
| 3,316,679 | 5/1967 | Wilson | 51/137 |
| 3,732,648 | 5/1973 | Schaller | 51/103 R |
| 5,123,213 | 6/1992 | Vinson | 51/103 R X |

FOREIGN PATENT DOCUMENTS

| | | | |
|---|---|---|---|
| 537980 | 10/1931 | Fed. Rep. of Germany | 51/103 WH |
| 141416 | 4/1980 | Fed. Rep. of Germany | 51/103 R |
| 674067 | 6/1952 | United Kingdom | 51/103 TF |

*Primary Examiner*—Bruce M. Kisliuk
*Assistant Examiner*—Bo Bounkong
*Attorney, Agent, or Firm*—Harness, Dickey & Pierce

[57] ABSTRACT

An improved micro-finishing machine is disclosed in which a transfer system is provided to move workpieces into and out of the machine in a path perpendicular to the axes of the machine drive rollers. The transfer system further enables an inprocess size control gauge to be added to the machine to monitor the diameter of the workpieces during micro-finishing. The machine offers greater flexibility by enabling the machine to be easily reconfigured to micro-finish other parts. The transfer system utilizes ejectors that are simple in construction, requiring a minimal number of components.

17 Claims, 4 Drawing Sheets

CENTERLESS MICROFINISHING MACHINE

This is a continuation of U.S. Pat. application Ser. No. 782,986, filed Oct. 28, 1991 entitled. Centerless Microfinishing Machine, abandoned Jan. 22, 1993.

BACKGROUND AND SUMMARY OF THE INVENTION

The present invention relates to a centerless micro-finishing machine, and in particular, to an improved machine having; a simplified part transfer system, improved accessibility to the work stations, flexibility to be easily reconfigured to micro-finish different parts, and the ability to accommodate an in-process size control gauge.

Centerless micro-finishing machines employ a pair of drive rollers for rotating a workpiece. The workpiece is supported and rotated by the rollers during micro-finishing. The workpieces are transferred into the machine by moving the workpiece in a direction parallel to the centerline of the rollers. It has been impossible or extremely difficult to perform in-process size control gauging with such a transfer system because the transfer system interferes with the gauge head located beneath the rollers. The transfer system is also complex, involving several linkages. Micro-finishing machines that have two work stations for two levels of micro-finishing typically are constructed by duplicating most of the components in a single station machine. This greatly adds to the complexity of the machine.

It is an object of the present invention to provide a centerless micro-finishing machine with a transfer mechanism that enables an in-process size control gauging to be performed.

It is a further object of the present invention to provide a centerless micro-finishing machine with a transfer mechanism that is simplified involving as few linkages as possible.

It is another objective of the present invention to provide a micro-finishing machine that includes the flexibility to be refigured to micro-finish parts having a different diameter and length.

It is yet another objective of the present invention to produce a micro-finishing machine having two work stations with a simplified drive system reducing the duplication of parts.

It is a feature of the present invention to transfer the workpiece by moving it in a path that is perpendicular to the centerline of the rollers. The transfer system does not interfere with the in-process size control gauge. The transfer system also is gentle on the workpiece, reducing damage caused by transfer.

It is an advantage of the transfer system that when micro-finishing parts shorter in length than the rollers, that multiple parts can be finished simultaneously, increasing machine productivity. The transfer system can be used with a magazine feeder for automatic part loading or it can be used with manual part loading.

By moving the part in a direction that is perpendicular to the rollers, a third roller can be added to create two work stations, thus allowing for two levels of polishing. The transfer system automatically moves the parts from one station to the next.

The machine is flexible in that it can accommodate pieces of different lengths. Further, by making the roller spacing adjustable, the machine can be reconfigured to micro-finish various diameter parts.

Further objects, features and advantages of the invention will become apparent from a consideration of the following description and the appended claims when taken in connection with the accompanying claims.

DETAILED DESCRIPTION OF THE INVENTION

Figure 1:
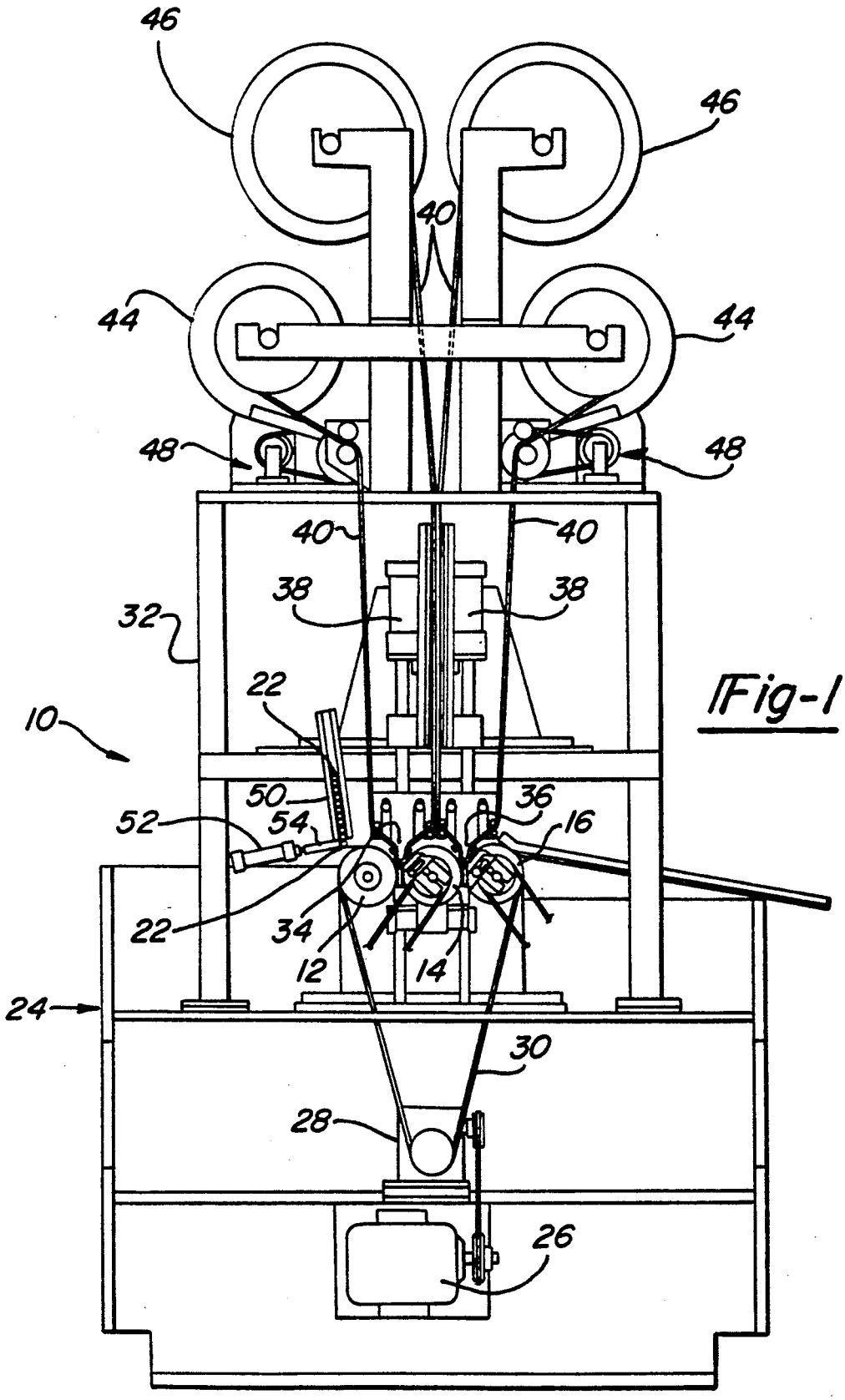
FIG. 1 is an elevational view of the micro-finishing machine of the present invention.
Figure 3:
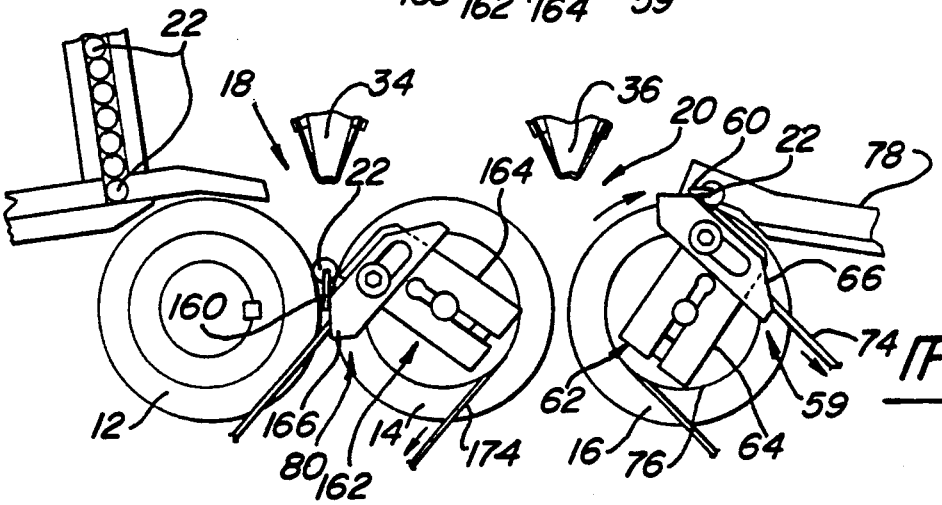
FIGS. 3 and 4 are enlarged views illustrating operation of the transfer system.
Figure 4:
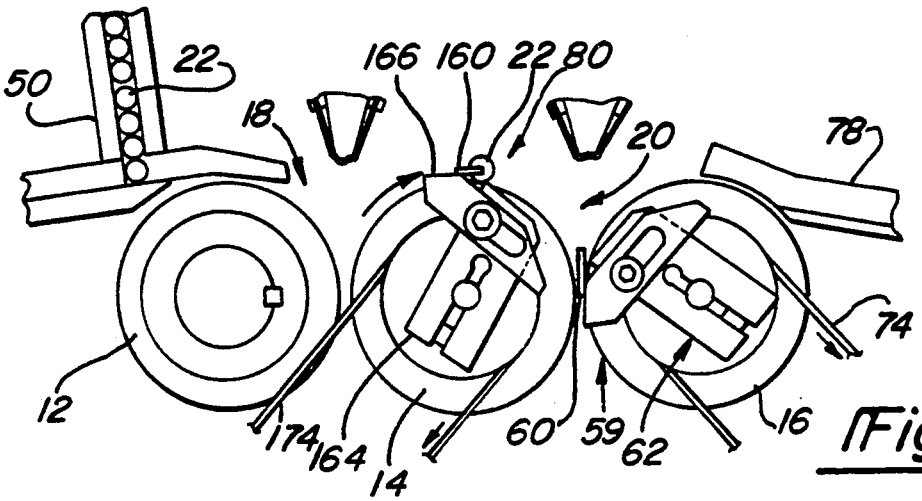

The micro-finishing machine of the present invention is shown in FIG. 1 and designated generally at 10. Machine 10 has three drive rollers 12, 14 and 16. Rollers 12 and 14 define a work station 18 therebetween while the rollers 14 and 16 define a work station 20 therebetween as best seen in FIG. 3. The rollers are parallel to one another, coplanar and spaced apart from another a distance less than the diameter of the workpieces 22 being micro-finished such that the workpieces are supported by adjacent rollers in the work stations. Preferably, the drive rollers are all of the same diameter.

The rollers are spaced from one another a distance so that a line connecting the centerline of one roller and the centerline of the workpiece placed in the work station is at approximately a 15° angle to a line connecting the centerlines of the two rollers. This angle provides the necessary frictional drive to rotate the workpiece.

Figure 2:
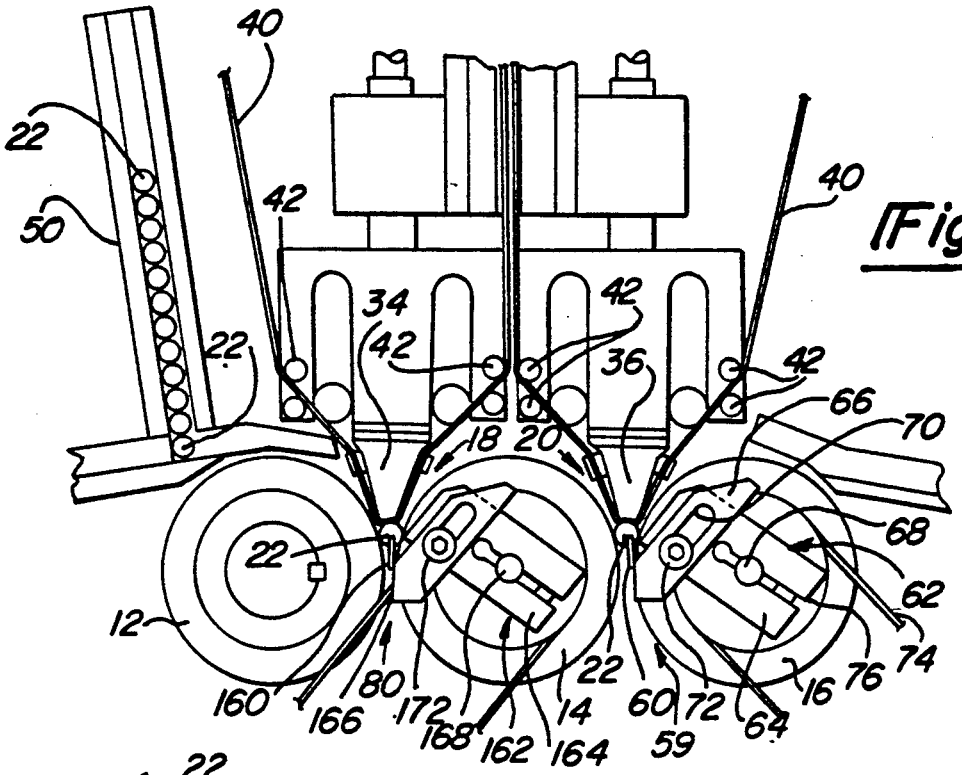
FIG. 2 is an enlarged view of the drive rollers and the transfer system used to move workpieces from one work station to the next and to eject workpieces.

The rollers are supported on a lower frame 24 which also supports a drive train including a drive motor 26 and transmission 28 coupled to the rollers through a belt or chain 30. The drive train is only shown by way of example, other drive trains can be used as well. Upper frame 32 supports the two polish shoes 34 and 36 above the work stations 18 and 20 respectively. The polish shoes are each carried by actuating cylinders 38 to raise and lower the shoes as needed. Each shoe carries an abrasive film 40 that is routed past the shoe by a plurality of guide rollers 42 best shown in FIG. 2. The abrasive film is supplied on spools 44 and taken up on spools 46 or on a chute or conveyor. Film drivers 48 are used to advance the film 40 so that the micro-finishing of each workpiece begins with a fresh abrasive surface.

Workpieces 22 to be micro-finished are contained in a magazine feeder 50 positioned adjacent to the first drive roller 12. An actuating cylinder 52 actuates a plunger 54 to cause the lowermost workpiece 22 to be rolled over roller 12 into the work station 18 between rollers 12 and 14. With a workpiece 22 in each of the work stations, the shoes 34 and 36 are lowered to press the abrasive films 40 against the workpieces. The rollers are then driven for rotation, thereby causing the workpieces to be rotated beneath the stationary abrasive film to micro-finish the surfaces of the workpieces. During finishing, the shoes and abrasive film are oscillated axially along the workpiece.

The abrasive film used at work station 18 can be coarser than the film used at work station 20 to provide a machine with two levels of polishing, level 1 and level 2, respectively. Polishing can be accomplished by rotating the drive rollers in only one direction, or, the roller direction can be reversed during the process such that polishing is done by rotating the workpieces in both directions.

The transfer system includes a pair of ejectors 59 and 80 for moving the workpieces from work stations 20 and 18 respectively. The two ejectors are identical and are described with reference to ejector 59. Ejector 59 includes a bail 60 extending between rollers 14 and 16 beneath the work station 20. The bail 60 is carried by a pair of arms 62 at the ends of the roller 16. The arms 62 are carried for rotation about the axis of the roller 16. Arms 62 are comprised of a pair of arm segments 64 and 66 that are at approximately right angles to one another. The radial position and extension of segment 64 is adjustable about the roller center pin 68 while the extension of segment 66 from segment 64 is also adjustable by slot 70 and nut 72. A drive chain or belt 74 around the pulley 76 is used to rotate the arm 62 and is driven by a conventional drive, not shown.

As the arms 82 are rotated, the workpiece 22 is raised from work station 22, over the roller 16 and onto a discharge slide 78 as shown in FIG. 3. After ejection of the part 22 from work station 20, the arm 62 is returned to its rest position shown in FIG. 2 in which the bail 60 is located beneath the work station 20.

An ejector 80 on roller 14 is identical to the ejector 59 on roller 16. The elements of ejector 80 have been given the same reference numerals with the addition of 100. After bail 60 is returned to its rest position beneath the work station 20, ejector 80 is actuated to move the workpiece from work station 18 over the roller 14 and into work station 20. Following operation, the bail 160 of ejector 80 is returned to its rest position beneath work station 18 for reception of the next workpiece 22 from the magazine feeder 50.

Figure 5:
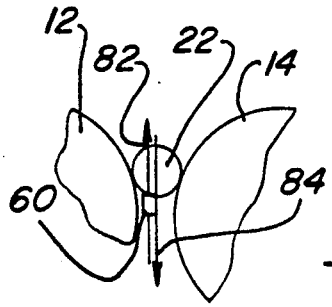
FIG. 5 is a fragmentary view of the transfer system.

The bails 60, 160 are effective in raising the workpieces to move them from one position to the next without the use of any additional guide structure. This is due to the location of the bails 60, 160 relative to the workpiece. The arms 62, 162 are adjusted such that the bails are located radially outwardly relative to the drive rollers 14, 16 further than the center of gravity of the workpieces 22. See FIG. 5 illustrating bail 160 and roller 14. When the bail 160 is lifted, the lifting force applied to the workpiece, designated by arrow 82, is radially outwardly of the center of gravity of workpiece 22 and the gravitational force on the workpiece represented by arrow 84. The lifting force 82 will thus cause the workpiece to remain in contact with the roller 14 rather than to follow roller 12. A torsional load is applied to the workpiece, causing it to rotate as it moves over roller 14.

The machine 10, by including a third drive roller, forms a machine with two work stations with a minimum number of additional components. By utilizing one of the rollers, roller 14 as shown, to form both work stations, the number of rollers can be reduced.

Figure 6:
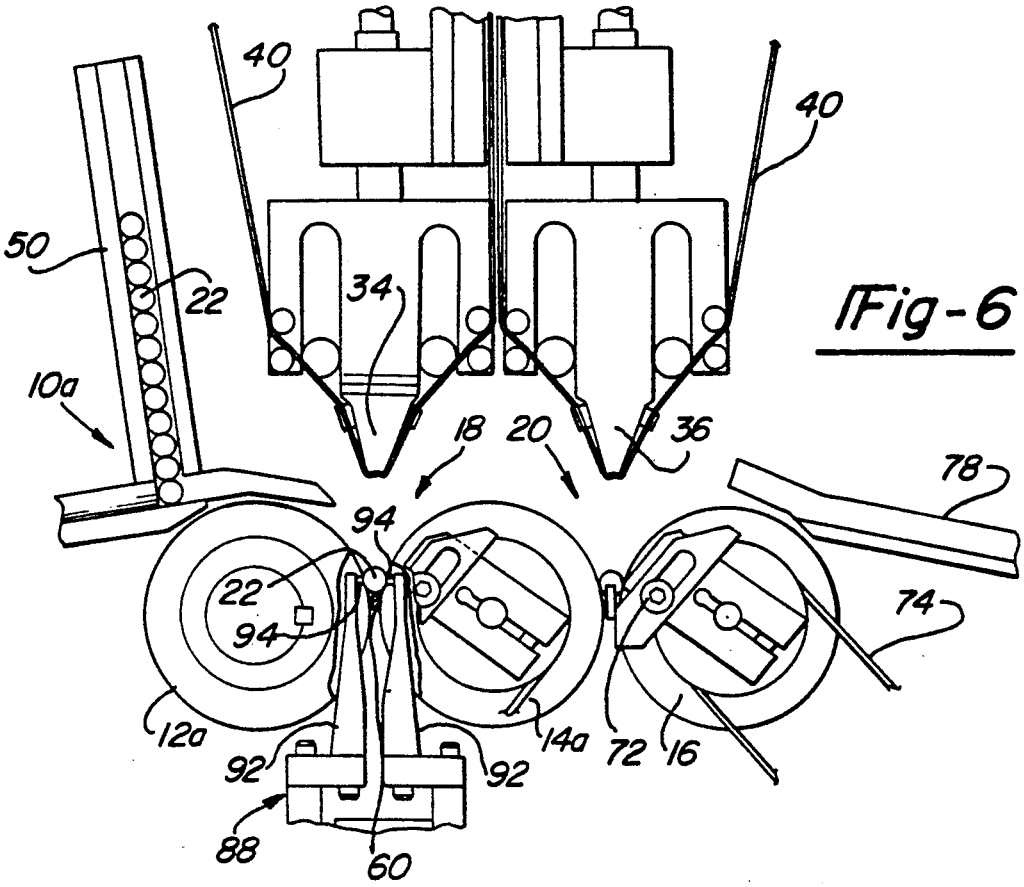
FIG. 6 is a side elevational view of the micro-finishing machine of the present invention equipped with an in-process size control gauge.
Figure 7:
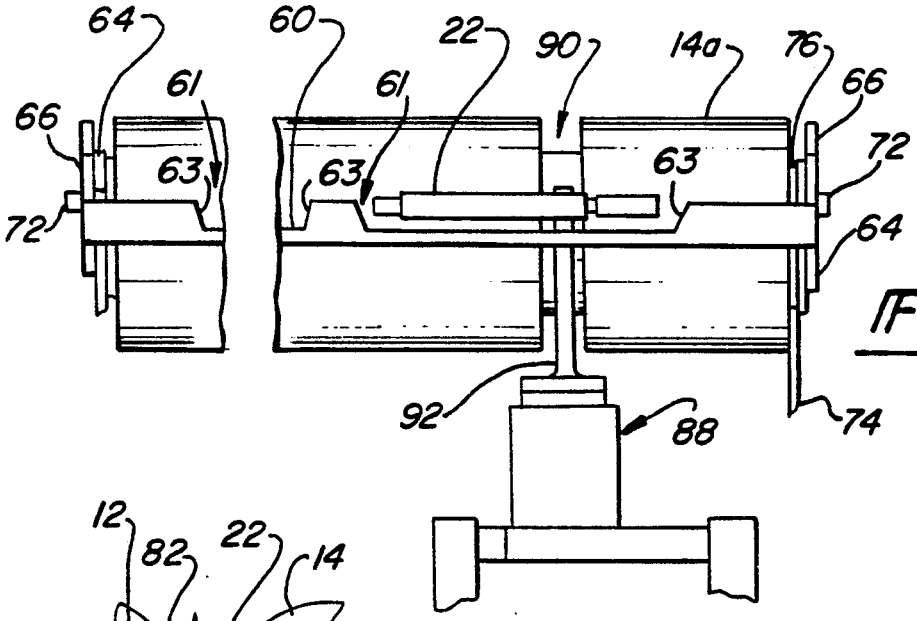
FIG. 7 is a side view of one drive roller of the machine shown in FIG. 6.

FIGS. 6 and 7 disclose an alternative embodiment, machine 10*a*, in which an in-process size control gauge has been added. In the machine 10*a*, like elements have been given identical reference numerals. Where elements have been modified, the reference numerals are followed by the suffix "a".

During operation, the direction of rotation of the rollers is reversed to improve the material removal. Since material removal is a part of the process in addition to providing a desired finish, machine 10*a* has been equipped with an in-process size control gauge 88 for use in monitoring the diameter of workpiece 22 during micro-finishing in work station 18. Rollers 12*a* and 14*a* include annular recesses 90 to accommodate the caliper arms 92 of the gauge 88. The head of gauge 88 is disposed below the rollers with the calipers extending upwardly into the recesses 90 such that the caliper arms are substantially maintained within these recesses. Only the contacts 94 extend beyond the periphery of the rollers for contact with the workpiece. The bail 160 of ejector mechanism 80 is sufficiently narrow to fit between the two caliper arms and thus does not interfere with the gauge.

The transfer system, by moving the workpieces through a path perpendicular to the longitudinal axis of both the workpiece and the rollers, enables the workpiece to be lowered inbetween the two gauge caliper arms. When the workpiece contacts the caliper arms, the arms will be forced to spread apart from one another in the normal direction of motion of the two caliper arms. If the workpiece is loaded by moving it in a direction parallel to the roller axes, contact with the caliper arms would force the caliper arms in a direction they are not intended to be moved. This can result in damage to both the gauge and the workpiece.

FIG. 7 shows roller 14*a* in a side view illustrating the annular recess 90 and the workpiece 22 in the work station. The bail 160 extends the entire length of roller 14*a* so that regardless of the workpiece size, the bail will be positioned beneath the workpiece. The bail is formed with recessed portions 61 into which the workpiece is positioned. The ends 63 of the recessed portions serve to axially confine the workpieces. The ends 63 are positioned to provide a clearance between the ends of the workpiece and the ends 63 of the recessed portions. For workpieces that are shorter than one half of the length of rollers, it is possible to machine multiple workpieces at a given time by axially spacing the workpieces along the roller 14*a* as shown in FIG. 7. In such a case, multiple magazine feeders would be used to move the workpieces into the first work station 18 and each workpiece would have its own polishing shoes 34 and 36 for micro-finishing the workpieces. Multiple part finishing is facilitated by the perpendicular path of the workpieces. Workpieces can easily and precisely be loaded into the work stations by positioning the feeder 50 where desired. Precise loading of multiple workpieces in a path parallel to the roller axes is difficult and cumbersome and is avoided with the present transfer system.

Figure 8:
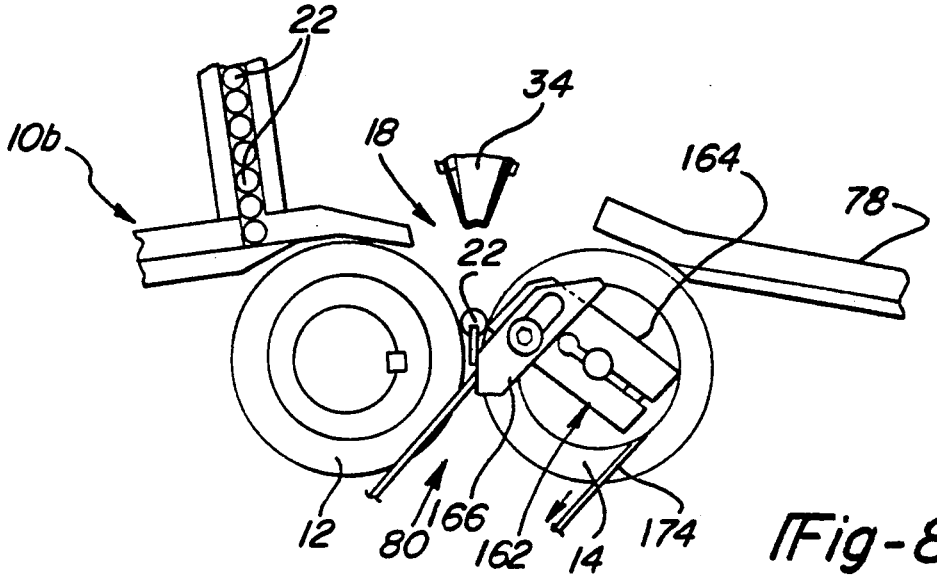
FIG. 8 is a fragmentary elevational view of a portion of a modified embodiment of the machine of the present invention equipped with only two drive rollers.

FIG. 8 shows another alternative embodiment of the machine of the present invention where again, like elements have been given the same reference numerals. Machine 10*b* is identical to machine 10 with the exception that roller 16 has been eliminated, producing a micro-finishing machine having a single work station 18 with the ejector mechanism 80 being used to remove the workpiece from the work station.

Figure 9:
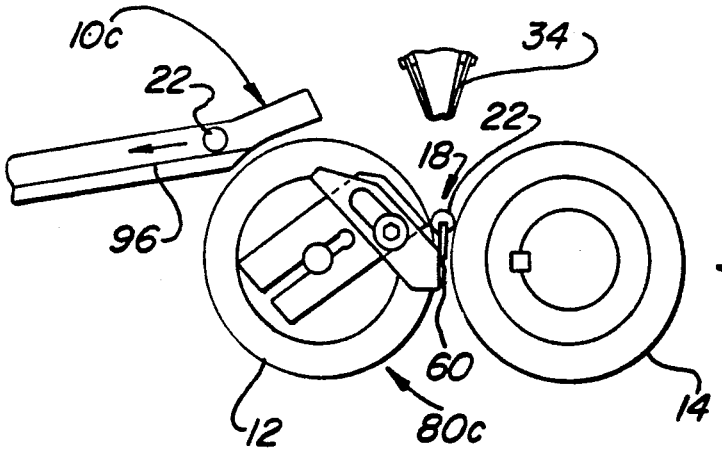
FIG. 9 is a fragmentary elevational view of yet another embodiment of the present invention in which the workpieces are ejected to the same side of the machine from which the workpieces are loaded.

Machines 10, 10*a* and 10*b* are generally categorized as through machines in that the workpieces are moved through the machine by loading into the machine from one side and ejected to the opposite side. An alternative to a through machine is shown in FIG. 9 with machine 10*c*. In this embodiment, the workpieces are loaded into the work station 18 by moving a part to the right, over roller 12, into the work station. The ejector mechanism 80*c* is mounted to the roller 12 and ejects the workpiece 22 by moving the workpiece from the work station to the left to eject it onto the discharge shoot 96 on the same side of the machine from which the part was loaded. Such a machine is manually loaded and is used when a smaller quantity of workpieces 22 are to be micro-finished, such that an automated loading mechanism is not required.

All of the machines use a transfer system in which the workpieces are moved in a direction perpendicular to the longitudinal axes of the drive rollers. As such, the machines are easily adapted to include an in-process size control gauge as shown with 10*a*. Furthermore, the machines of the present invention are advantageous in that workpiece transferring is conducted gently, reducing the possibility and likelihood of damage to the workpieces during transfer. A further advantage is the simple ejectors used comprising a pair of lever arms and a bail extending the length of the rollers. Complex linkages are avoided. The bails function to move the workpieces without the need of a guide structure over the rollers. This results in clear access to the workpiece for the polish shoes.

By equipping the machines with drive rollers that can be adjusted to vary the spacing therebetween, it is possible to easily reconfigure the machine to micro-finish workpieces of different diameters. This improves the flexibility and usefulness of the machine.

It is to be understood that the invention is not limited to the exact construction illustrated and described above, but that various changes and modifications may be made without departing from the spirit and scope of the invention as defined in the following claims.

We claim:

1. A centerless micro-finishing machine comprising:

a first and second parallel drive rollers spaced from one another a distance less than the diameter of a cylindrical workpiece to be finished whereby the workpiece can be supported by said rollers in a first work station defined between said rollers and rotated by rotation of said rollers;

a polish shoe carrying an abrasive film positioned above said first work station and being moveable between a raised position above said first work station and a lowered finishing position in which said abrasive film is pressed against the workpiece in said first work station for finishing the workpiece; and an ejector for removing the workpiece from said first work station after micro-finishing including a bail extending the length of said second roller and at least one arm carrying said bail with said lever arm at an end of said second roller and said lever arm being rotatable about the axis of rotation of said second roller to move said bail upwardly from a rest position below said first work station to move the workpiece up and over said second roller to eject the workpiece from said first work station when said polish shoe is moved to said raised position.

2. The micro-finishing machine of claim 1 further comprising means for automatically loading the workpiece into said first work station by rolling the workpiece over said first roller into said first work station.

3. The micro-finishing machine of claim 1 wherein said lever arm is adjustable in radial length to accommodate various spacings between said rollers.

4. The micro-finishing machine of claim 3 wherein said lever arm has a first arm segment extending radially from the center of said second roller and a second arm segment coupled to said first arm segment and extending from said first arm segment at an angle to the radially extending direction of said first arm segment.

5. The micro-finishing machine of claim 4 wherein the extension of said second arm segment from said first arm segment is adjustable and the radial extension of said first arm segment form said second roller center is also adjustable.

6. The micro-finishing machine of claim 4 further comprising means for gauging the diameter of the workpiece during micro-finishing.

7. The micro-finishing machine of claim 6 wherein said gauging means includes a pair of gauge caliper arms extending between said rollers to said first work station with one caliper arm on each side of said first work station with each caliper arm being disposed in an annular recess in said rollers.

8. The micro-finishing machine of claim 1 wherein said bail is positioned to contact the workpiece radially outwardly from the centerline of the workpiece whereby lifting force applied to the workpiece by the bail holds the workpiece in contact with said second roller.

9. The micro-finishing machine of claim 1 wherein said bail is formed with a recessed portion to axially capture the workpiece in said work station.

10. The micro-finishing machine of claim 1 further comprising a third drive parallel to said second drive roller and spaced from said second drive roller a distance less than the diameter of the cylindrical workpiece whereby the workpiece can be supported by said second and third rollers in a second work station defined between said second and third rollers.

11. The machine of claim 10 further comprising:

a second ejector for removing the workpiece from said second work station after micro-finishing including a second bail extending the length of said third roller and a second lever arm carrying said second bail, said second lever arm at an end of said third roller and being rotatable about the axis of said third roller to move said second bail upwardly from a rest position below said second work station to move the workpiece up and over said third roller to eject the workpiece from said second work station.

12. A micro-finishing machine for finishing the surface of a cylindrical workpiece comprising:

first, second and third rollers having parallel axes of rotation, said rollers being spaced from one another a distance less than the diameter of the workpiece whereby said rollers define a first work station between said first and second rollers and a second work station between said second and third rollers;

a first polish show carrying a first abrasive film positioned above said first work station and a second polish shoe carrying a second abrasive film and positioned above said second work station, said polish shoes being movable between a raised position above said work stations and lowered positions in which said abrasive films are presses against the workpiece in said work stations; and first and second ejectors for removing the workpieces from said first and second work stations respectively after micro-finishing, said first ejector including a first bail extending the length of said second roller and a first lever arm carrying said first bail at an end of said second roller to move said first bail upwardly from a rest position below said first work station to move the workpiece up and over said second roller to said second work station, said second ejector including a second bail extending the length of said third roller and a second lever arm carrying said second bail at an end of said third roller and being rotatable about the axis of said third roller to move said second bail upwardly from a rest position below said second work station to move the workpiece up and over said third roller to eject the workpiece from said second work station.

13. The micro-finishing machine of claim 12 further comprising means for automatically loading the workpiece into said first work station by rolling the workpiece over said first roller into said first work station.

14. A micro-finishing machine of claim 12 wherein said lever arms are adjustable in radial length to accommodate various spacings between said rollers.

15. The micro-finishing machine of claim 12 wherein said bails are positioned to contact the workpiece radially outwardly from the centerline of the workpiece whereby lifting forces applied to the workpiece by the bails hold the workpiece in contact with the rollers about which the bails are rotated.

16. The micro-finishing machine of claim 12 further comprising means for gauging the diameter of one of said workpieces in one of said work stations during micro-finishing.

17. The micro-finishing machine of claim 16 wherein said gauging means includes a pair of gauge caliper arms extending between two of said rollers with one of said caliper arms on each side of at least one of said work stations with each caliper arm being disposed in an annular recess in two of said rollers.

* * * * *

UNITED STATES PATENT AND TRADEMARK OFFICE

CERTIFICATE OF CORRECTION

PATENT NO. : 5,231,798

DATED : August 3, 1993

INVENTOR(S) : Norman R. Judge and Arthur G. Reiser

It is certified that error appears in the above-identified patent and that said Letters Patent is hereby corrected as shown below:

Column 5, line 62, Claim 1, after "at least one" please insert --lever--.

Column 6, line 40, Claim 10, after "third drive" insert --roller--.

Column 7, line 4, Claim 12, after "are" delete "presses" and insert therefor --pressed--.

Column 7, line 11, Claim 12, after "second roller" insert --and being rotatable about the axis of said second roller--.

Signed and Sealed this

Eighth Day of March, 1994

Bruce Lehman

*Attest:*

BRUCE LEHMAN

*Attesting Officer*

*Commissioner of Patents and Trademarks*